US008966680B2

(12) United States Patent
Dowd et al.

(10) Patent No.: US 8,966,680 B2
(45) Date of Patent: Mar. 3, 2015

(54) TOP RAIL LOCK FOR PLAYYARD

(71) Applicant: Cosco Management, Inc., Wilmington, DE (US)

(72) Inventors: Paul Dowd, Scarsdale, NY (US); Philippe M Putzeys, New York, NY (US); Christopher David Miller, Bronxville, NY (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 146 days.

(21) Appl. No.: 13/725,520

(22) Filed: Dec. 21, 2012

(65) Prior Publication Data

US 2013/0160205 A1 Jun. 27, 2013

Related U.S. Application Data

(60) Provisional application No. 61/579,965, filed on Dec. 23, 2011.

(51) Int. Cl.
*A47D 7/00* (2006.01)

(52) U.S. Cl.
USPC ..... 5/99.1; 5/98.1

(58) Field of Classification Search
USPC ..... 5/99.1, 98.1, 93.1
See application file for complete search history.

(56) References Cited

U.S. PATENT DOCUMENTS

| | | | |
|---|---|---|---|
| 4,376,318 | A | 3/1983 | Cirillo |
| 4,614,454 | A | 9/1986 | Kassai |
| 4,811,437 | A | 3/1989 | Dillner et al. |
| 4,934,025 | A | 6/1990 | Mariol |
| 4,985,948 | A | 1/1991 | Mariol |
| 5,197,154 | A | 3/1993 | Shamie |
| 5,211,498 | A | 5/1993 | Huang |
| 5,228,154 | A | 7/1993 | Brevi et al. |
| 5,239,714 | A | 8/1993 | Huang |
| 5,241,716 | A | 9/1993 | Kohus |
| 5,279,006 | A | 1/1994 | Teng |
| 5,293,656 | A | 3/1994 | Chan |
| 5,353,451 | A | 10/1994 | Hsiung |
| 5,358,220 | A | 10/1994 | Yu-Kuang |
| 5,377,368 | A | 1/1995 | Cheng |
| 5,446,931 | A | 9/1995 | Wei |
| 5,454,124 | A | 10/1995 | Huang |
| 5,457,828 | A | 10/1995 | Huang |
| 5,474,404 | A | 12/1995 | Chien |
| 5,530,977 | A | 7/1996 | Wang |
| 5,617,592 | A | 4/1997 | Cheng |
| 5,685,660 | A | 11/1997 | Liao |
| 5,730,542 | A | 3/1998 | Cheng |
| 5,761,755 | A | 6/1998 | Huang |
| 5,791,804 | A | 8/1998 | Cheng |
| 5,803,650 | A | 9/1998 | Wu |
| 5,906,013 | A | 5/1999 | Wang |
| 5,964,545 | A | 10/1999 | Cheng |

(Continued)

FOREIGN PATENT DOCUMENTS

| | | |
|---|---|---|
| GB | 2387779 | 10/2003 |

*Primary Examiner* — Fredrick Conley
(74) *Attorney, Agent, or Firm* — Barnes & Thornburg LLP

(57) ABSTRACT

A playyard includes a collapsible frame having a rail support adapted to support a playyard floor and a playyard top rail. The playyard top rail includes a left rail segment and a right rail segment. The left rail segment and the right rail segment move relative to one another from an inline use position to a folded-storage position when the playyard is collapsed for storage or transportation.

30 Claims, 10 Drawing Sheets

(56) References Cited

U.S. PATENT DOCUMENTS

| | | | | |
|---|---|---|---|---|
| 5,978,987 | A | 11/1999 | Wang | |
| 5,988,928 | A | 11/1999 | Cheng | |
| 6,018,846 | A | 2/2000 | Huang | |
| 6,082,922 | A | 7/2000 | Cheng | |
| 6,250,837 | B1 | 6/2001 | Mariol et al. | |
| 6,302,613 | B1 | 10/2001 | Lan | |
| 6,343,390 | B1 | 2/2002 | Yang et al. | |
| 6,349,434 | B1 * | 2/2002 | Zhuang | 5/99.1 |
| D460,679 | S | 7/2002 | Longenecker | |
| 6,510,568 | B1 | 1/2003 | Drobinski et al. | |
| 6,729,791 | B1 | 5/2004 | Chen | |
| 6,851,135 | B1 | 2/2005 | Chen | |
| 7,043,779 | B2 | 5/2006 | Mendenhall et al. | |
| 7,343,634 | B2 | 3/2008 | Song | |
| 7,568,242 | B2 | 8/2009 | Troutman | |
| 7,574,757 | B2 | 8/2009 | Song | |
| 7,674,223 | B2 | 3/2010 | Jones | |
| 7,958,601 | B2 | 6/2011 | Yu et al. | |
| 8,069,533 | B2 | 12/2011 | Yu et al. | |
| 2002/0138900 | A1 | 10/2002 | Hu | |
| 2003/0061658 | A1 | 4/2003 | Longenecker | |
| 2011/0085847 | A1 | 4/2011 | Anderson | |
| 2011/0229251 | A1 * | 9/2011 | Yeh | 403/81 |

* cited by examiner

TOP RAIL LOCK FOR PLAYYARD

PRIORITY CLAIM

This application claims priority under 35 U.S.C. §119(e) to U.S. Provisional Application Ser. No. 61/579,956, filed Dec. 23, 2011, which is expressly incorporated by reference herein.

BACKGROUND

The present disclosure relates to a juvenile playyard, and particularly to a collapsible frame for a juvenile playyard. More particularly, the present disclosure relates to a collapsible playyard frame including top rail segments that fold up when the playyard frame is collapsed.

SUMMARY

A playyard in accordance with the present disclosure includes a collapsible frame. The collapsible frame includes a multi-segment top rail and a rail support coupled to the top rail and adapted to support a playyard floor.

In illustrative embodiments, a playyard top rail includes a left rail segment and a right rail segment. Both the left rail segment and the right rail segment are coupled to a bracket for pivotable movement relative to the bracket. The rail segments move relative to the bracket from an inline-use position to a folded-storage position when a playyard including the playyard top rail is collapsed for storage or transportation.

In illustrative embodiments, the playyard top rails further includes a rail segment lock associated with the left and right rail segments. The rail segment lock moves from a locked position, blocking the left and right rail segments from moving to the folded-storage position, to an unlocked position, allowing the left and right rail segments to move to the folded-storage position. The rail segment lock is moved to the unlocked position by a user lifting the bracket, pressing a blocker-mover button included in the rail segment lock, and dropping the bracket while continuing to press the blocker-mover button.

In illustrative embodiments, the playyard top rail also includes visual means for indicating the position of the rail segment lock so that a caregiver can quickly determine if the rail segment lock is in the locked or unlocked position. The visual means includes a locked indicator coupled to the rail segment lock and an unlocked indicator coupled to the bracket. The locked indicator is illustratively green in color. It is exposed when the rail segment lock is in the locked position. The unlocked indicator is illustratively red in color and is exposed when the rail segment lock is in the unlocked position.

Additional features of the disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
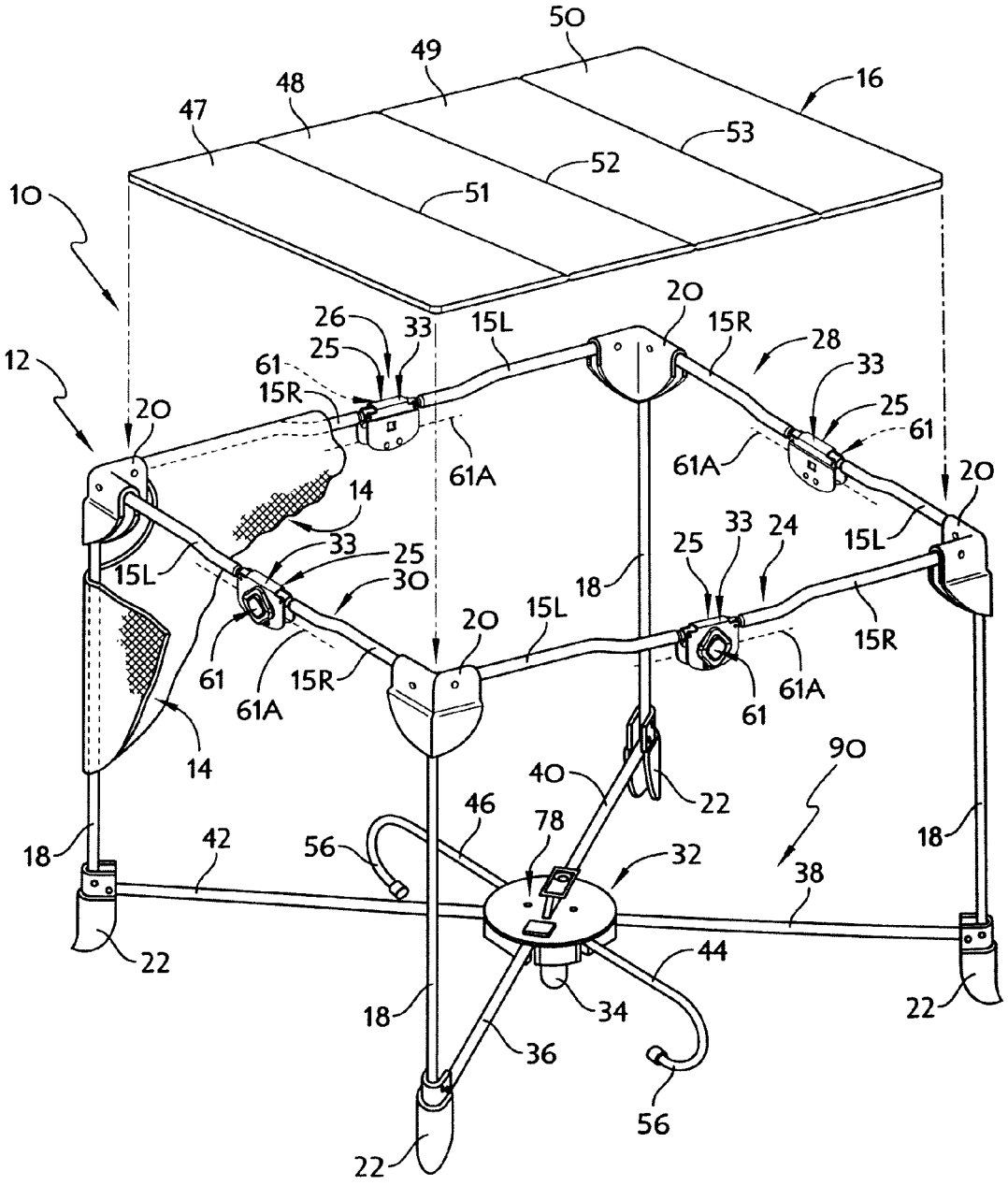
FIG. 1 is a perspective view of a playyard including a playyard floor mat, a fabric cover, and a collapsible frame for supporting the floor mat and the fabric cover in accordance with the present disclosure showing that the frame includes four top rails, each including a bracket, left and right rail segments, a rail segment lock, and a lock status indicator (shown in detail in FIG. 9)
Figure 2:
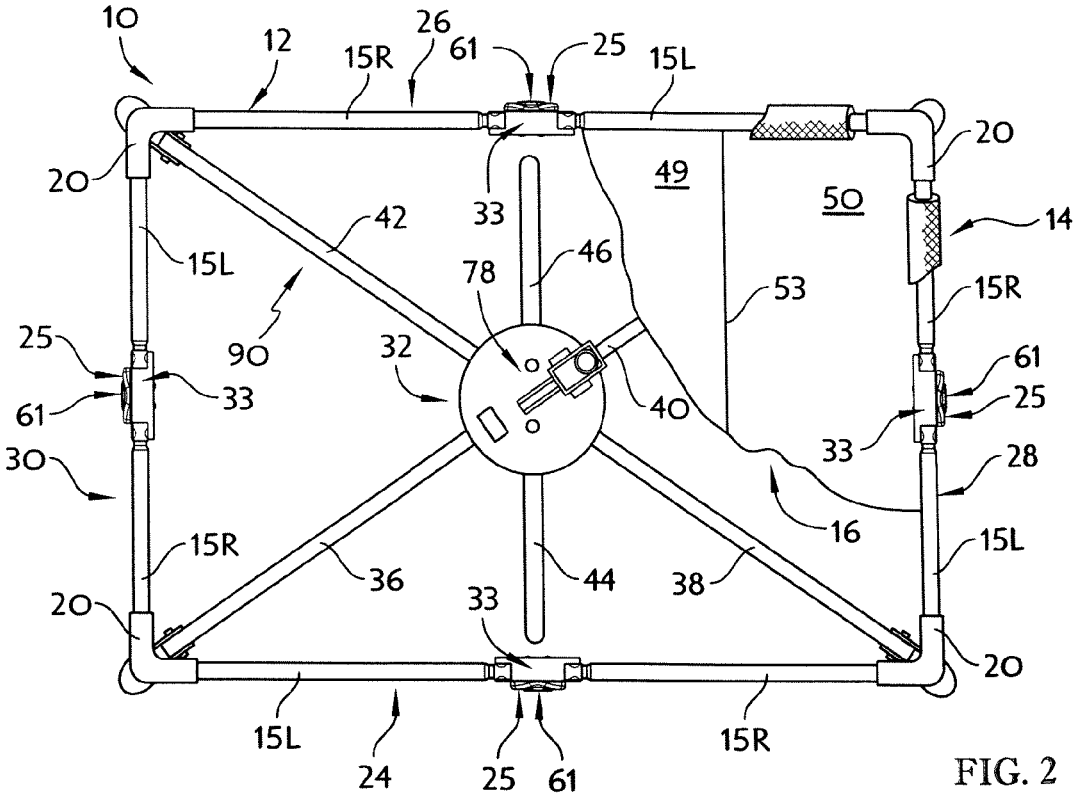
FIG. 2 is a top plan view of the playyard of FIG. 1, showing four top rails included in the frame arranged in a rectangular pattern around floor support rails.
Figure 3:
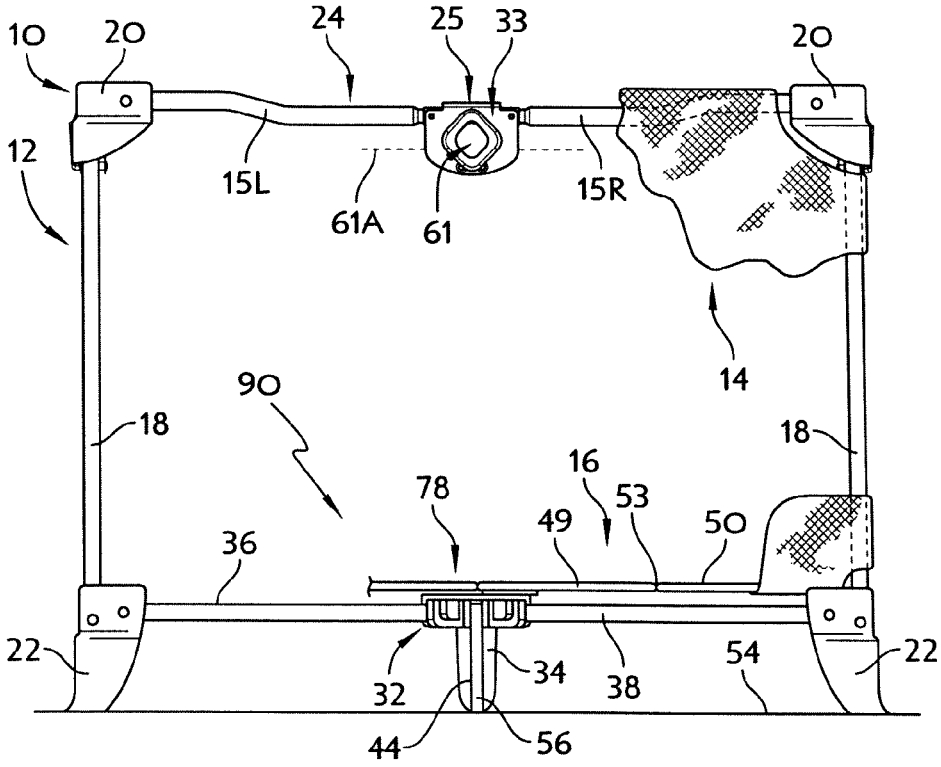
FIG. 3 is a side elevation view of the playyard of FIG. 2 showing a front-top rail including rail segments held in an inline-use position by a front-top rail segment lock.
Figure 4:
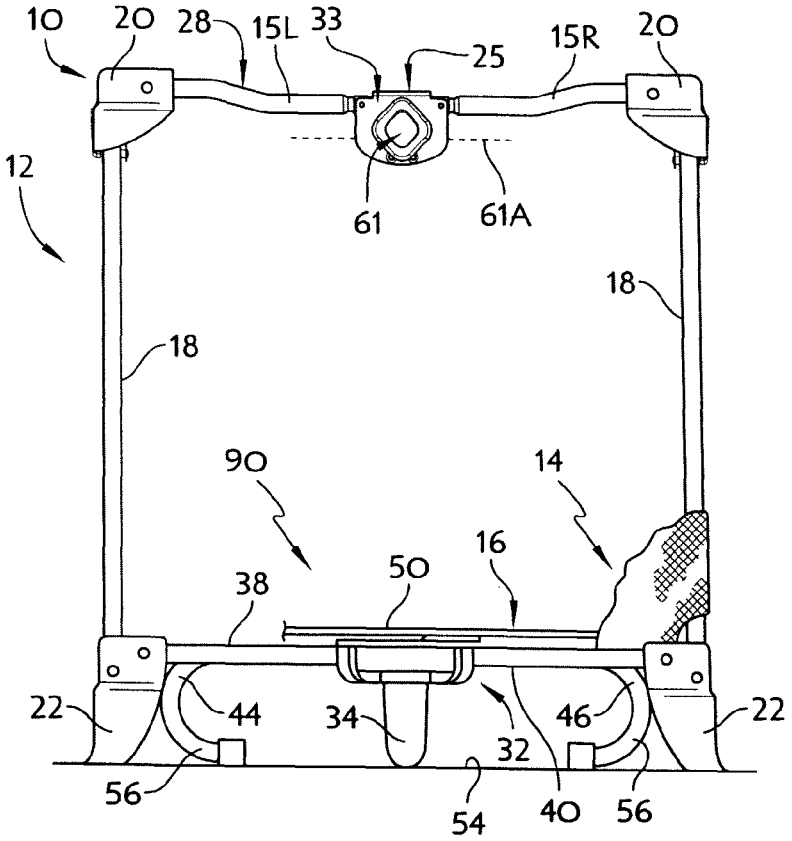
FIG. 4 is an end elevation view of the playyard of FIGS. 2 and 3 showing a left-side-top rail including rail segments held in an inline-use position by a left-side-top rail segment lock.

Playyard 10 includes a collapsible frame 12, fabric frame cover 14, and removable floor mat 16. Frame cover 14 is made of sturdy fabric and netting material and is foldable to enable frame 12 to be moved easily from an erected configuration shown in FIGS. 1-4 to a collapsed configuration shown in FIGS. 6-8. Floor mat 16 is removed from frame 12 (as shown in FIG. 1) prior to collapsing frame 12. Once frame 12 is collapsed, the four-segment floor mat 16 can be folded, wrapped around collapsed frame 12, and secured using straps (not shown) to provide a case for storing and/or carrying collapsed frame 12.

Collapsible frame 12 includes a rail support 90 configured to support a playyard floor (illustratively floor mat 16) and foldable top rails 24, 26, 28, and 30. Rail support 90 includes four corner legs 18, a corner piece 20 at the top end of each corner leg 18, and a corner foot 22 at the bottom end of each corner leg 18. Top rails 24, 26, 28, and 30 interconnect each pair of adjacent corner pieces 20.

Figure 9:
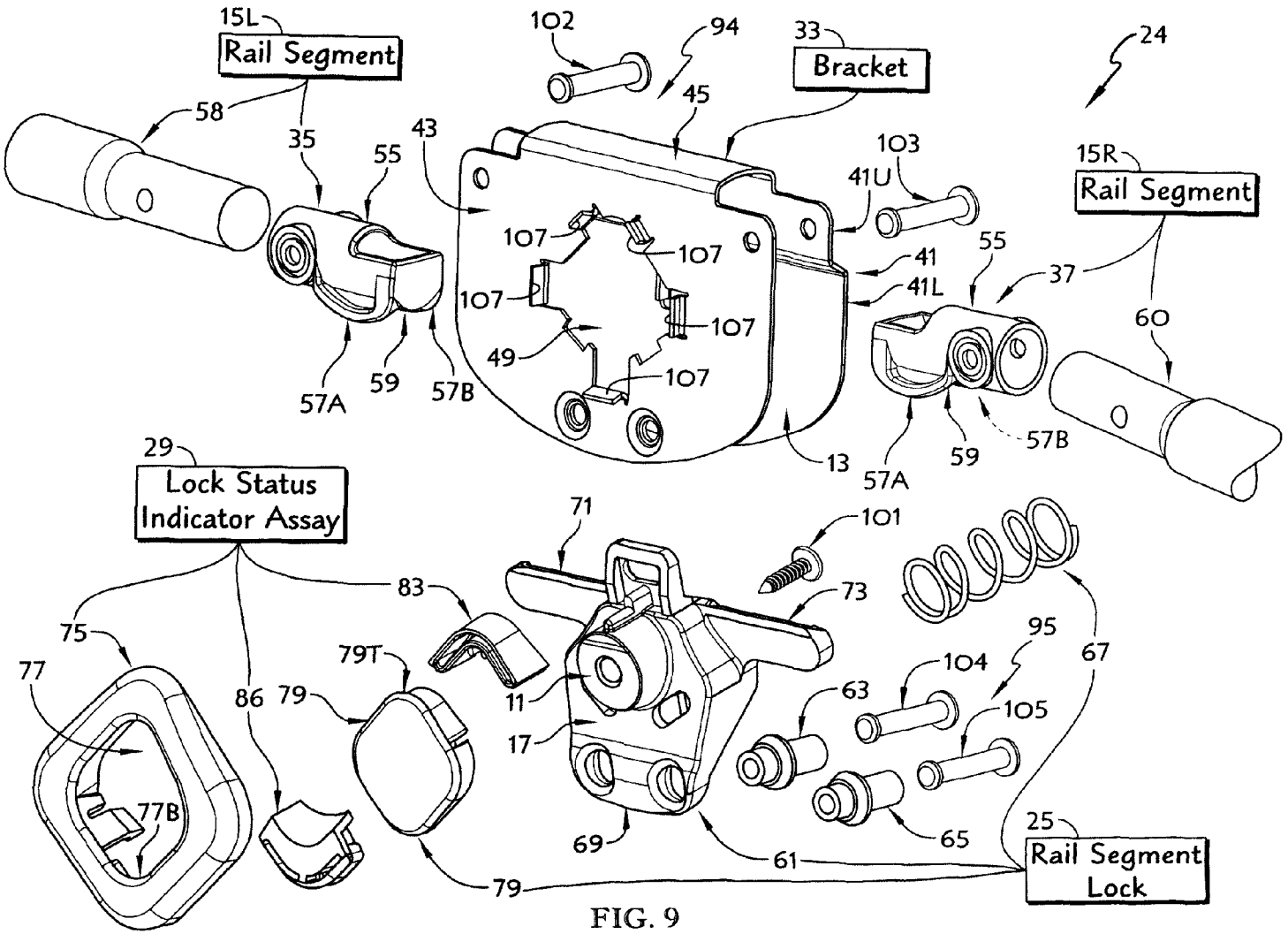
FIG. 9 is an exploded perspective view of a top rail showing that the releasable segment lock includes a T-shaped rail-motion blocker, a blocker-mover button, and a blocker-biasing spring, and showing that the lock-status indicator includes a bezel with a central opening, an unlocked indicator, and a locked indicator.

Each foldable top rail 24, 26, 28, and 30 includes a central rail segment 94, a left rail segment 15L, a right rail segment 15R, and a rail segment lock 25 as shown in FIG. 9. Central rail segment 94 includes a bracket 33, a left fastener pin 102, and a right fastener pin 103. In each foldable top rail 24, 26, 28, and 30, left and right rail segments 15L, 15R are coupled to bracket 33 of center rail 94 for rotation about a pivot axes 35A, 37A from an inline-use position (shown in FIG. 14) to a folded-storage position (shown in FIG. 17). Rail segment lock 25 of each foldable top rail 24, 26, 28, and 30 is locked to hold corresponding left and right rail segments 15L, 15R in the inline use position while frame 12 is in the erected configuration and is unlocked to allow the corresponding rail segments 15L, 15R to pivot upwardly relative to bracket 33 to the folded-storage position so that frame 12 may be collapsed for storage or transportation.

Figure 14:
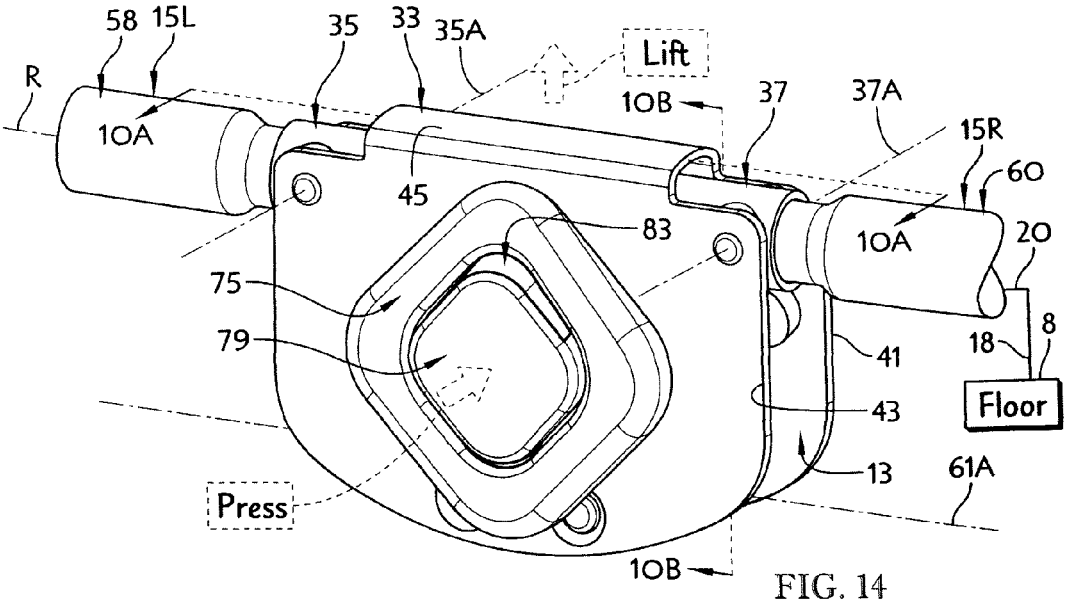
FIG. 14 is a perspective view of the top rail with the rail segments in the inline-use position and the rail segment lock in the locked position showing that the locked indicator is coupled to the top of the blocker-mover button and is exposed suggesting to a user that the rail segment lock is locked.
Figure 14A:
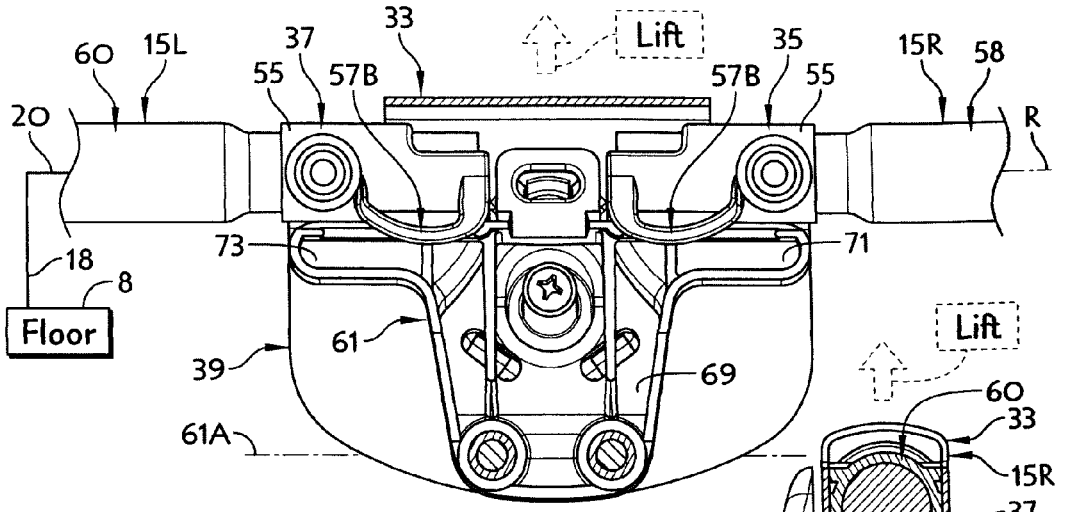
FIG. 14A is a cross-sectional view of the top rail of FIG. 14 taken along line 10A showing that the rail-motion blocker is blocked from pivoting about a lock axis by arcuate protrusions included in the rail segments.
Figure 14B:
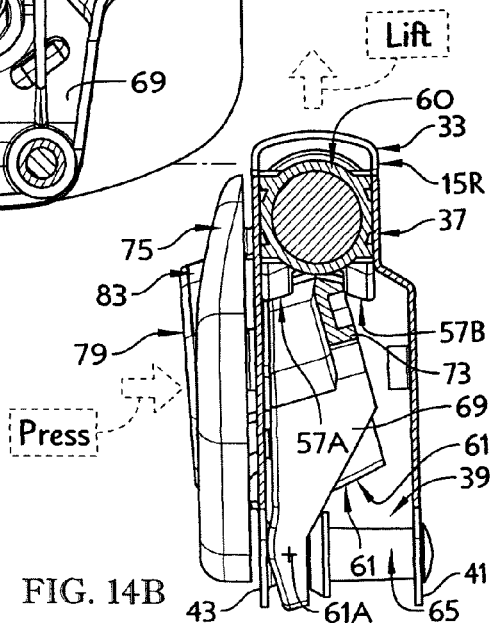
FIG. 14B is a cross-sectional view of the releasable segment lock of FIG. 14 taken along line 10B showing that the rail segments are blocked from pivoting upwardly relative to the bracket by the rail-motion blocker so that the playyard is blocked from collapsing.

Each top rail 24, 26, 28, 30 is substantially similar and the following description of top rail 24 is applicable to each top rail 24, 26, 28, 30. Bracket 33 of top rail 24 is U-shaped and is formed from a bent monolithic steel sheet as shown in FIG. 9. Left rail segment 15L is coupled to bracket 33 for pivotable movement about a left pivot axis 35A by a pin 102. Rail segment 15R is coupled to bracket 33 for pivotable movement about a pivot axis 37A by a pin 103 as shown in FIG. 14. Releasable segment lock 25 is housed in bracket 33 and is movable to block or allow pivoting of rail segments 58, 60 relative to bracket 33.

Bracket 33 of the illustrative embodiment supports rail segment lock 25 and is formed to include a back wall 41, a front wall 43, and a top wall 45 as shown, for example, in FIG. 9. Back wall 41 is spaced from front wall 43 by top wall 45 and includes a jog 47 so that a lower portion 41L of back wall 41 is spaced further from front wall 43 than an upper portion 41U of back wall 41. Front wall 43 is formed to include an opening 49 and a number of tabs 107 extending away from back wall 41 located around opening 49. Tabs 107 are configured to block frame cover 14 from entering bracket 33. Top wall 45 extends between back wall 41 and front wall 43 over a portion of the length of back wall 41 and front wall 43.

Left rail segment 15L is coupled to bracket 33 to pivot relative to bracket 33 about left pivot axis 35A as shown in FIG. 14. Right rail segment 15R is coupled to bracket 33 to pivot relative to bracket 33 about right pivot axis 37A. Left rail segment 15L includes a left rail tube 58 and an end cap 35 as shown in FIG. 9. Right rail segment 15R includes a right rail tube 60 and an end cap 37 as shown in FIG. 9. Each end cap 35, 37 is formed to include a cylindrical rail receiver 55 and a pair of curved protrusions 57A, 57B extending down from rail receiver 55 and forming a channel 59 therebetween.

Rail segment lock 25 of the illustrative embodiment includes a rail-motion blocker 61, a blocker-mover button 79, and a biasing blocker-biasing spring 67 as shown in FIG. 9. Rail-motion blocker 61 is a monolithic component formed from a plastics material and includes a T-shaped portion 17 and a hub 11. T-shaped portion 17 includes a button-support stem 69, a left rail-segment blocker arm 71 extending outwardly from button-support stem 69, and a right rail-segment blocker arm 73 extending outwardly from button-support stem 69. Hub 11 extends forwardly from button-support stem 69 of T-shaped portion 17. Button-support stem 69 of rail-motion blocker 61 is coupled to bracket 33 for movement about a lock axis 61A as shown in FIG. 14. Blocker-mover button 79 is coupled to hub 11 for movement with hub 11.

Rail-motion blocker 61 is coupled to bracket 33 by a pair of pins 104, 105. A pair of spacer sleeves 63, 65 wrap around pins 104, 105 and engage button-support stem 69 of rail-motion blocker 61 to bias rail-motion blocker 61 away from back wall 41 of bracket 33. Blocker-mover button 79 is coupled to rail-motion blocker 61 by a screw 101. Blocker-biasing spring 67 cooperates with spacer sleeves 63, 65 to bias rail-motion blocker 61 away from back wall 41 of bracket 33.

Top rail 24 also includes a lock status indicator assembly 29 configured to inform a user visually of rail segment lock 25 position. Lock status indicator assembly 29 illustratively includes a bezel 75, an unlocked indicator 81, and a locked indicator 83 as shown in FIG. 9. Bezel 75 includes a central opening 77 that aligns with opening 49 in bracket 33. Unlocked indicator 81 is coupled to bezel 75 and is exposed for viewing by a user when rail segment lock 25 is in the unlocked position. Locked indicator 83 is coupled to blocker-mover button 79 and is exposed for viewing by a user when releasable segment lock 25 is in the locked position.

Unlocked indicator 81 in the illustrative embodiment is formed from a plastics material in a red color. Locked indicator 83 in the illustrative embodiment is formed from a plastics material in a green color. In other embodiments, indicators 81, 83 may be embossed or marked with words indicating unlocked and locked. In other embodiments, indicators 81, 83 may be formed with different textures indicating unlocked and locked condition.

Referring now to FIG. 14, top rail 24 is shown with rail segments 58, 60 in an inline position and with rail segment lock 25 in the locked position. When rail segments 15L, 15R are in the inline position, rail-motion blocker 61 is blocked from pivoting about lock axis 61A out of the way of the rail segments by arcuate protrusions 57A, 57B extending down from sleeves 55 of end caps 35, 37. When rail segment lock 25 is in the locked position, locked indicator 83 coupled to the top of blocker-mover button 79 is exposed suggesting to a user that rail segment lock 25 is in the locked position. Also, segments 15L, 15R are blocked from pivoting upwardly relative to bracket 33 by lock 39 so that playyard 10 is blocked from being collapsed. To move rail segment lock 25 to the unlocked position, a user lifts bracket 33 and presses blocker-mover button 79 as suggested by phantom arrows 120, 122 in FIG. 14.

Figure 15:
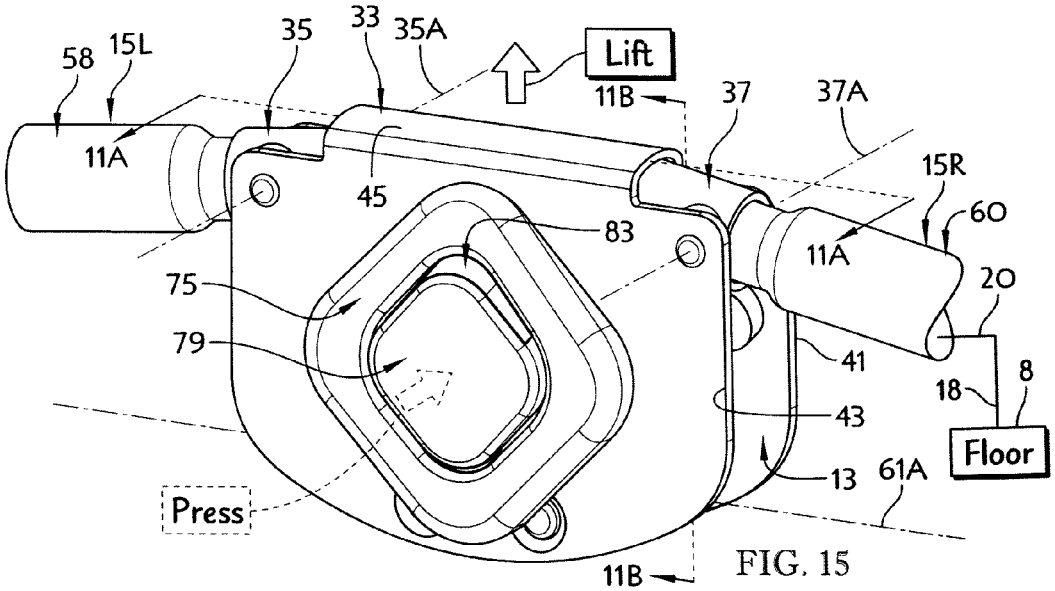
FIG. 15 is a perspective view of the top rail of FIG. 14 with the rail segments in a lifted position and the releasable segment lock in the locked position showing that the bracket has been lifted so that the rail segments are pivoted downwardly slightly relative to the bracket.
Figure 15A:
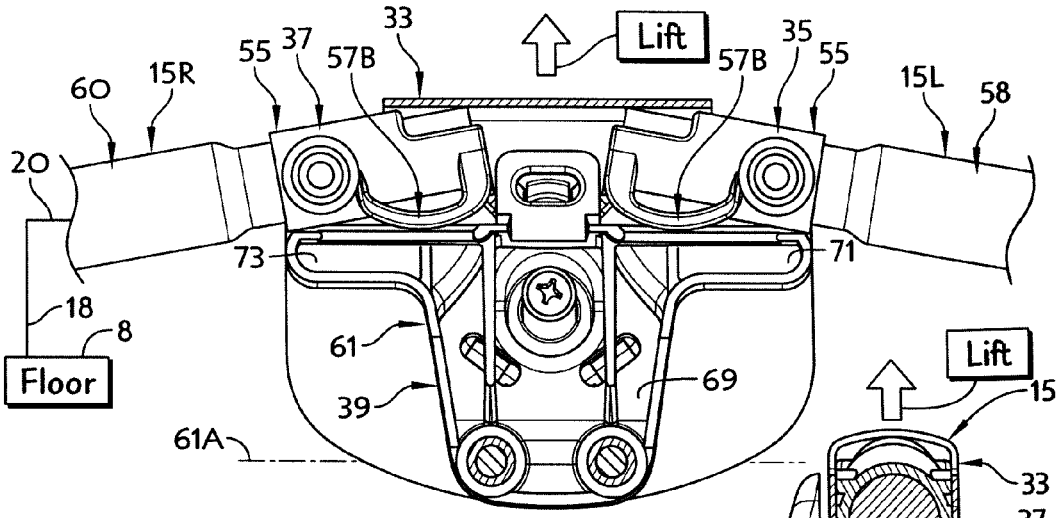
FIG. 15A is a cross-sectional view of the top rail of FIG. 15 taken along line 11A showing that the rail segments are pivoted downwardly slightly relative to the bracket such that the rail-motion blocker is free to pivot about the lock axis to move to the unlocked position when a user passes the blocker-mover button.
Figure 15B:
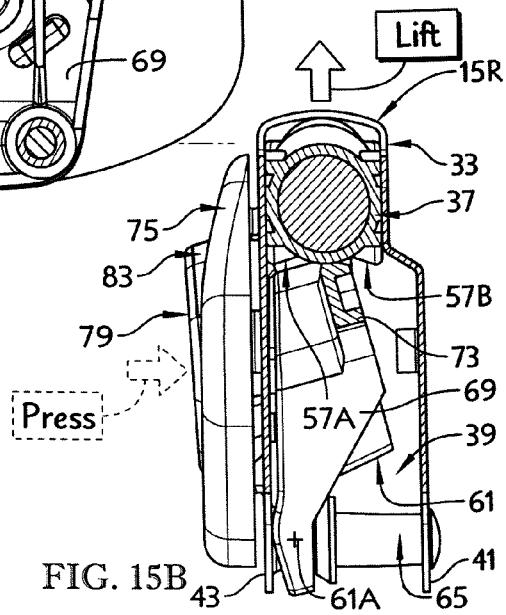
FIG. 15B is a cross-sectional view of the top rail of FIG. 15 taken along line 11B showing that the rail segments are blocked from pivoting upwardly relative to the bracket by the rail-motion blocker so that the playyard is blocked from being collapsed before a user presses the blocker-mover button included in the rail segment lock to unlock the rail segment lock.

Referring now to FIG. 15, rail segments 15L, 15R have been moved to a lifted position while rail segment lock 25 remains in the locked position. When bracket 33 is lifted, rail segments 15L, 15R are pivoted downwardly slightly relative to bracket 33. When rail segments 15L, 15R are pivoted downwardly, rail-motion blocker 61 is free to pivot about lock axis 61A so that rail segment lock 25 is in the unlocked position. However, while rail segment lock 25 remains in the locked position, rail segments 15L, 15R are blocked from pivoting upwardly relative to bracket 33 by rail-motion blocker 61 so that playyard 10 is blocked from being collapsed. To unlock rail segment lock 25, a user must press blocker-mover button 79 after lifting bracket 33 as suggested by phantom arrow 122 in FIG. 15.

Figure 16:
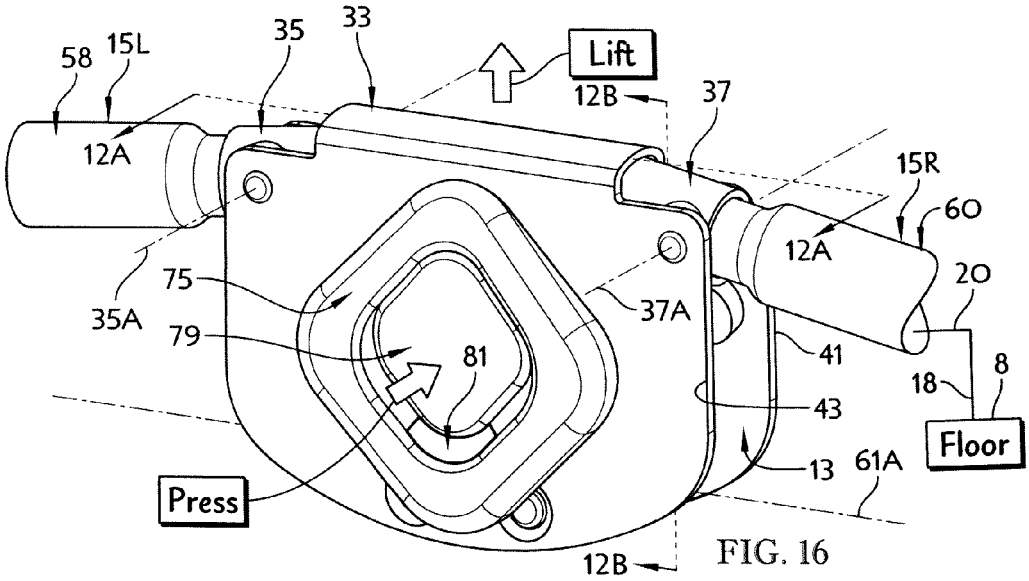
FIG. 16 is a perspective view of the top rail of FIG. 15 with the rail segments in the lifted position and the rail-motion blocker in the unlocked position showing that the bracket has been lifted so that the rail segments are pivoted downwardly slightly relative to the bracket and showing that the blocker-mover button of the rail segment lock has been pressed so that the unlocked indicator is exposed suggesting to a user that the rail segment lock is unlocked.
Figure 16A:
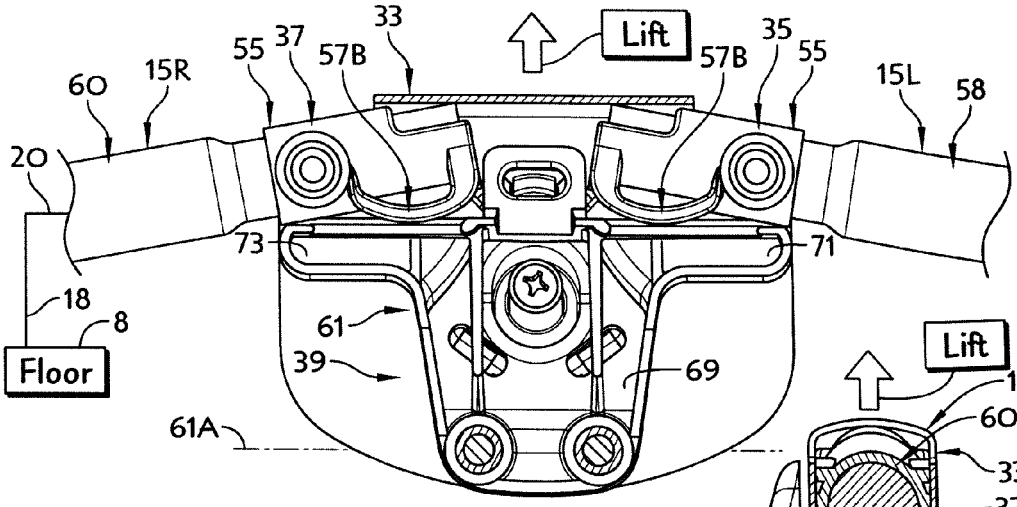
FIG. 16A is a cross-sectional view of the top rail of FIG. 16 taken along line 12A showing that the rail segments remain pivoted downwardly slightly relative to the bracket, while the rail-motion blocker is pivoted about the lock axis to the unlocked position.
Figure 16B:
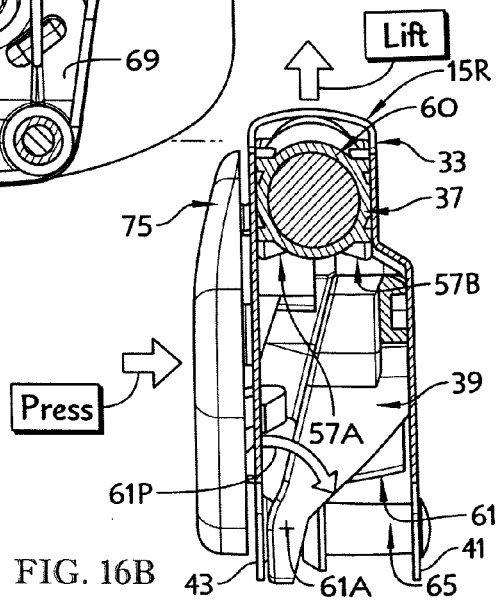
FIG. 16B is a cross-sectional view of the top rail of FIG. 16 taken along line 12B showing that the blocker-mover button has been pressed so that the rail-motion blocker is pivoted about the lock axis to the unlocked position in contact with the back of the bracket freeing the rail segments to pivot upwardly relative to the bracket collapsing the playyard.

Referring now to FIG. 16, a user has pressed blocker-mover button 79 and rail segment lock 25 is moved to the unlocked position. When blocker-mover button 79 is pressed, rail-motion blocker 61 is pivoted about lock axis 61A as suggested by arrow 61P. By pivoting rail-motion blocker 61 about lock axis 61A toward back wall 41 of bracket 33, rail segments 15L, 15R are allowed to pivot upwardly relative to bracket 33 so that playyard 10 can collapse. Also, locked indicator 83 is retracted into bracket 33 and hidden from a user. Unlocked indicator 81 is exposed by blocker-mover button 79 pivoting with rail-motion blocker 61 through bezel 75 suggesting to a user that rail segment lock 25 is unlocked.

Figure 17:
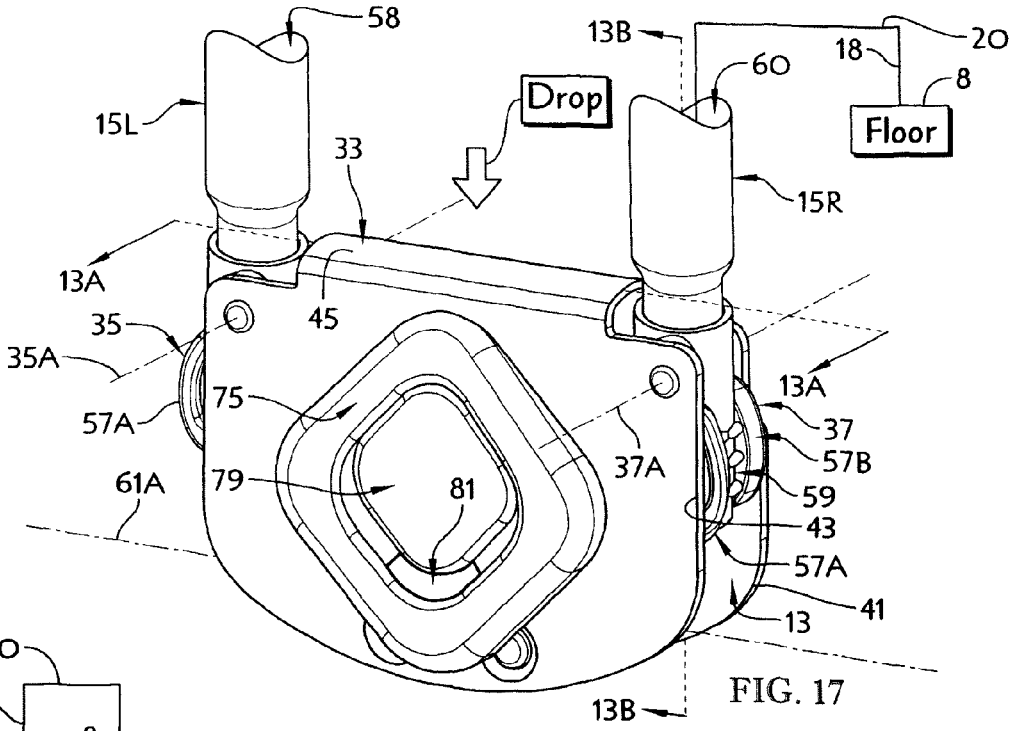
FIG. 17 is a perspective view of the top rail of FIG. 16 with the rail-motion blocker in the unlocked position when the top rail is collapsed showing that the bracket has been dropped so that the rail segments are pivoted upwardly relative to the bracket to the folded-storage position, and showing that the blocker-mover button is held in the pressed position so that the unlocked indicator remains exposed suggesting to a user that the rail segment lock is unlocked.
Figure 17A:
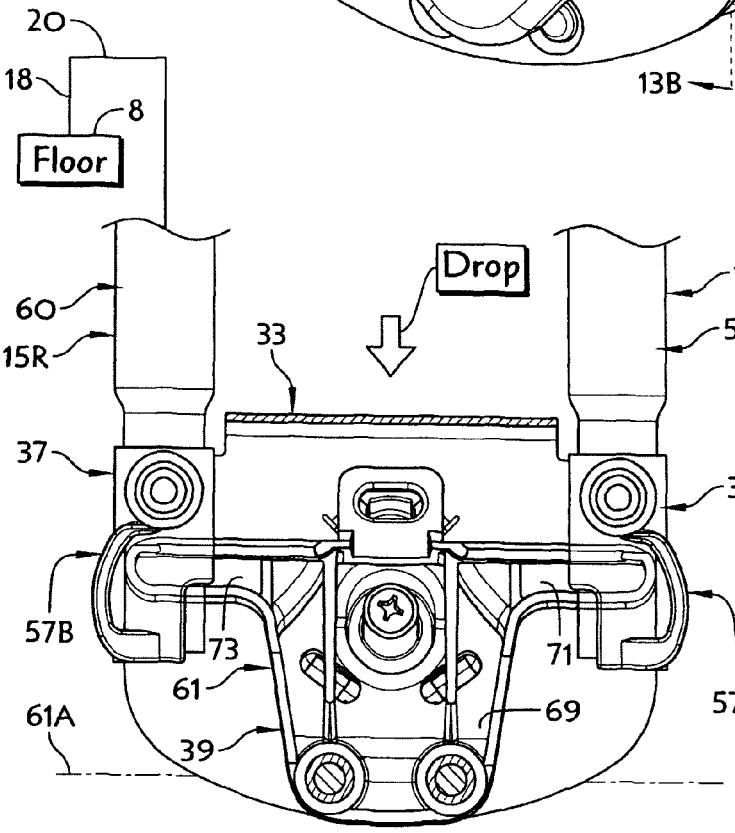
FIG. 17A is a cross-sectional view of the top rail of FIG. 17 taken along line 13A showing that the rail segments are pivoted upwardly relative to the bracket and that the rail-motion blocker is blocked from pivoting about the lock axis away from the back of the bracket.
Figure 17B:
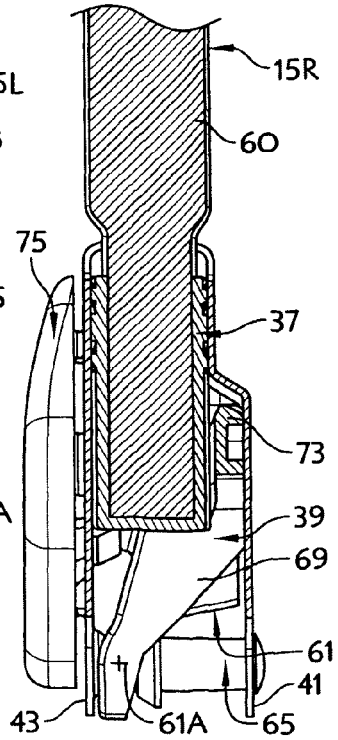
FIG. 17B is a cross-sectional view of the top rail of FIG. 17 taken along line 13B showing that the rail segments are pivoted upwardly relative to the bracket so that the rail-motion blocker is held contact with the back of the bracket, maintaining the releasable segment lock in the unlocked position.

Referring now to FIG. 17, a user has dropped bracket 33 after unlocking rail segment lock 25 so that rail segments 15L, 15R are pivoted upwardly relative to bracket 33 to assume the folded-storage position. When rail segment lock 25 is in the unlocked position and the rail segments are in the folded-storage position, rail segment lock 25 is held in the unlocked position as shown in FIGS. 17B and 17C. Also, unlocked indicator 81 remains exposed suggesting to a user that rail segment lock 25 is unlocked. Rail-motion blocker 61 is held away from front wall 43 of bracket 33 near back wall 41 of bracket 33 by rail segments 15L, 15R that block rail-motion blocker 61 from pivoting back toward front wall 43 of bracket 33.

Rail support 90 also includes a rail mount 32, a foot 34 for elevating rail mount 32, and a support rail 36, 38, 40, or 42 interconnecting rail mount 32 and each of corner feet 22 as suggested in FIGS. 1-8. Frame 12 also includes two auxiliary support rails 44, 46 coupled to rail mount 32.

Floor mat 16 includes four sections 47, 48, 49, and 50 arranged in series as shown in FIG. 1. Section 47 is coupled to section 48 at fold line 51, section 48 is coupled to section 49 at fold line 52, and section 49 is coupled to section 50 at fold line 53. Floor mat 16 can be unrolled to assume the flat configuration shown in FIG. 1 and then dropped in place to provide a sturdy playyard floor supported in an elevated position above the ground 54 underlying playyard 10 by rail mount 32 and support rails 36, 38, 40, 42, 44, and 46.

Figure 6:
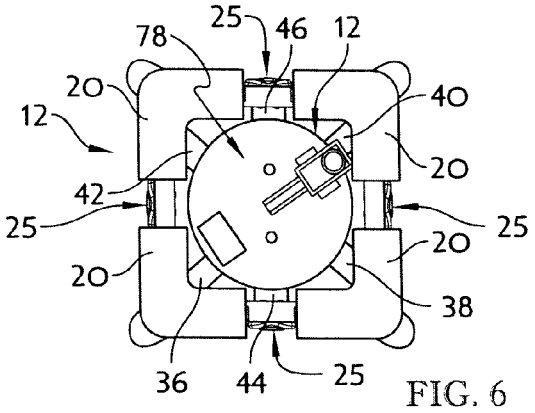
FIG. 6 is a top plan view of the playyard of FIG. 2 showing the playyard collapsed and showing that the rail segment locks are positioned to lie between each pair of adjacent L-shaped corner pieces.
Figure 7:
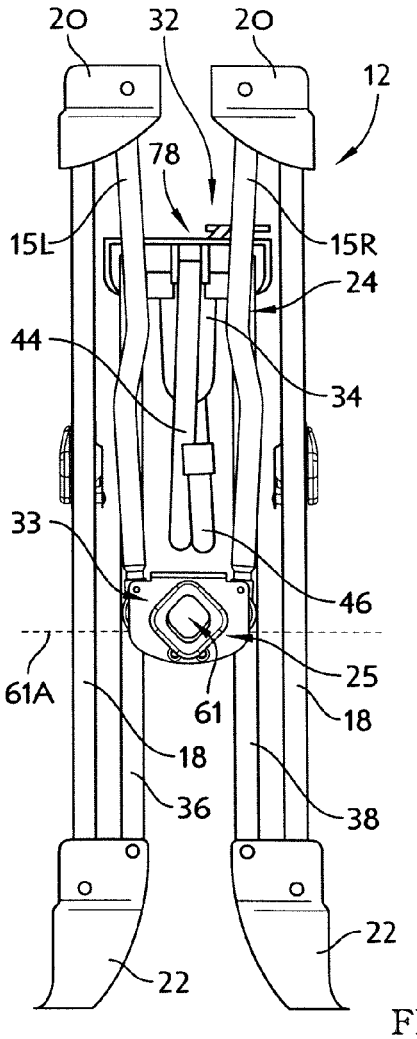
FIG. 7 is a side elevation view of the playyard collapsed showing the left and right rail segments of the front-top rail in the folded-storage position extending upwardly from the bracket.
Figure 8:
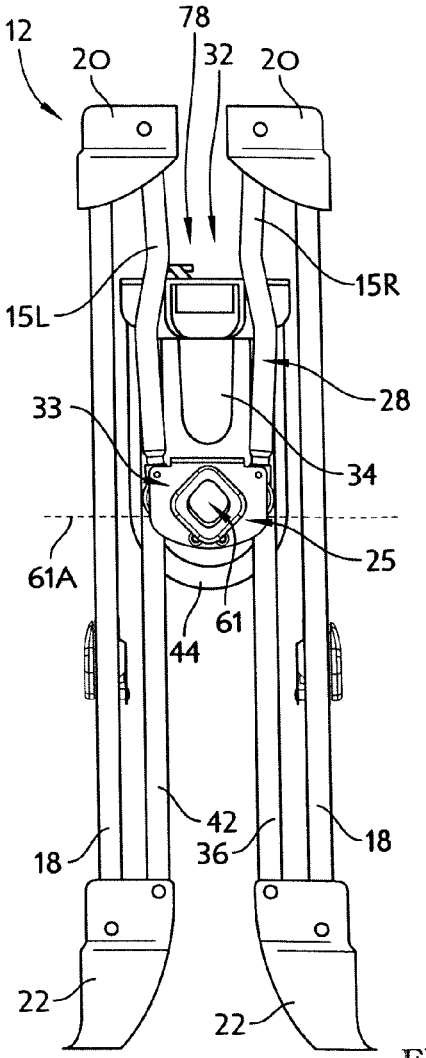
FIG. 8 is an end elevation view of the playyard collapsed showing the left and right rail segments of the left-side-top rail in the folded-storage position extending upwardly from the bracket.

Each of support rails 36, 38, 40, and 42 has an outer end pivotably coupled to one of corner feet 22 and an inner end pivotably coupled to rail mount 32 so as to facilitate collapsing movement of frame 12 from its erected configuration shown in FIGS. 1-4 to its collapsed configuration shown in FIGS. 6-8. Each of auxiliary support rails 44 and 46 has an inner end pivotably coupled to rail mount 32 and an outer end formed to define a rail support foot 56 as shown, for example, in FIGS. 1 and 4. Once assembled, support rails 46, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

A releasable rail lock apparatus 78 is provided in rail mount 32 and configured to lock certain of support rails 36, 38, 40, 42 to rail mount 32 when frame 12 is in its erected configuration as shown in FIG. 1. In the illustrated embodiment, rail lock apparatus 78 is configured to engage each of support rails 36, 40 and thereby block pivoting movement of support rails 36, 40 relative to rail mount 32 when frame 12 is in its erected configuration as shown in FIG. 1 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIG. 5 during controlled collapse of frame 12.

Figure 5:
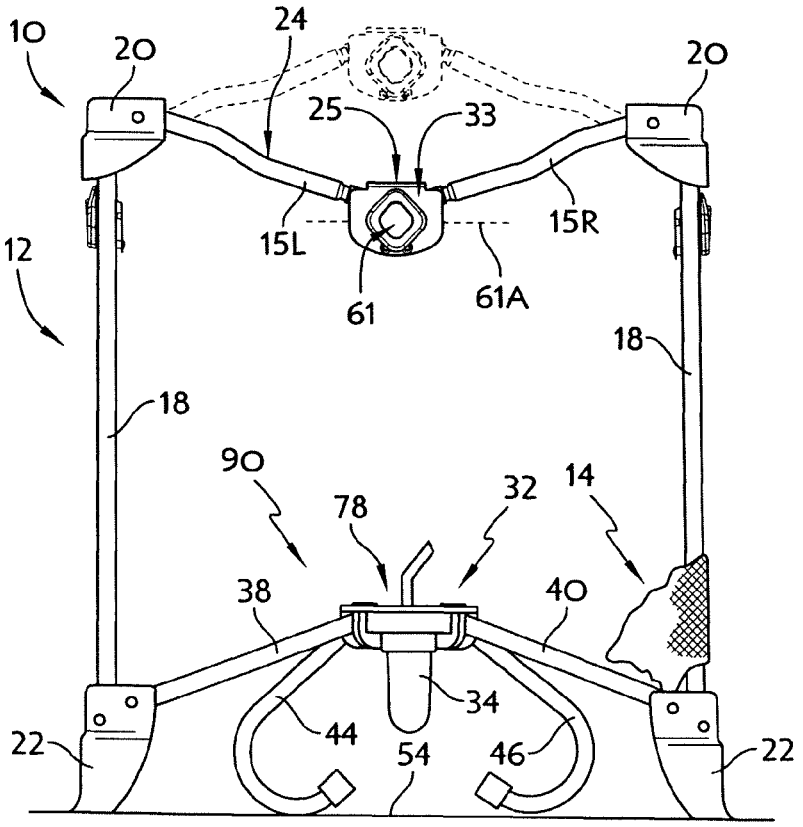
FIG. 5 is a view similar to FIG. 4 of the playyard as it is being collapsed following unlocking of the left-side-top releasable segment lock along with unlocking of releasable segment locks in each of the other top rails to allow relative movement of left and right rail segments in each of the four top rails toward a folded-storage position.

Referring now to FIGS. 1 and 5, playyard 10 can be collapsed by removing floor mat 16, manually actuating releasable rail lock apparatus 78 and then raising rail mount 32 away from ground 54 to collapse support rails 36, 38, 40, 42, 44, 46 partially, and then actuating each of four releasable segment locks 24, 26, 28, or 30 as described herein to collapse top rails 24, 26, 28, 30 partially. Then frame 12 can be collapsed further to assume a fully collapsed configuration shown, for example, in FIGS. 6-8. Finally, if desired, floor mat 16 can be wrapped around collapsed frame 12 and secured using suitable means to provide a storage case or carrying case for collapsed frame 12.

According to an embodiment of the present disclosure, a playyard 10 may include a collapsible frame 12 and a rail segment lock 25. Collapsible frame 12 may include a rail support adapted 90 to support a playyard floor 16 and a top rail 24. Rail support 90 is configured to fold to be moved between an erected configuration to support playyard floor 16 and a collapsed configuration without playyard floor 16. Top rail 24 may be coupled to rail support 90 of collapsible frame 12 and may be arranged to lie above a playyard floor 16 supported on rail support 90 of collapsible frame 12 upon movement of rail support 90 of collapsible frame 12 to the erected configuration.

Top rail 24 may include a left rail segment 15L coupled to a left corner leg 18 included in rail support 90 of collapsible frame 12, a right rail segment 15R coupled to a right corner leg 18 included in rail support 90 of collapsible frame 12, and a center rail segment 94 arranged to interconnect left and right rail segments 15L, 15R and to support left and right rail segments 15L, 15R for movement relative to one another between an inline-use position wherein left and right rail segments 15L, 15R are arranged to extend along a generally horizontal reference R extending between left and right corner legs 18 and a folded-storage position wherein left and right rail segments 15L, 15R are arranged to extend in a generally vertical orientation in substantially perpendicular relation to the generally horizontal reference line R.

Center rail segment 94 includes a button-support bracket 33, a left fastener 102, coupled to bracket 33 and to left rail segment 15L to support left rail segment 15L for movement relative to bracket 33 during movement of left and right rail segments 15L, 15R between the inline-use and folded-storage positions, and a right fastener 103 coupled to bracket 33 and to right rail segment 15R to support right rail segment 15R for movement relative to bracket 33 during movement of left and right rail segments 15L, 15R between the inline-use and folded-storage positions.

Rail segment lock 25 includes a rail-motion blocker 61 mounted on bracket 33 for pivotable movement about a generally horizontal pivot axis 61A that is arranged to lie in substantially spaced-apart parallel relation to the generally horizontal reference line R when rail support 90 of collapsible frame 12 is in the erected configuration and left and right rail segments 15L, 15R are in the inline-use position between a rail-locking position engaging left and right rail segments 15L, 15R to block movement of left and right rail segments 15L, 15R toward the folded-storage position and a rail-unlocking position disengaging left and right rail segments 15L, 15R to free left and right rail segments 15L, 15R to move toward the folded-storage position.

In some embodiments, rail segment lock 25 may further include a blocker-biasing spring 67 coupled to bracket 33 and to rail-motion blocker 61. The blocker-biasing spring 67 may be configured to provide means for yieldably urging rail-motion blocker 61 to move relative to bracket 33 normally to assume the rail-locking position.

In some embodiments, rail-motion blocker 61 may include a stem 69, a left rail-segment blocker arm 71, and a right rail-segment blocker arm 73. Stem 69 may be mounted for pivotable movement about generally horizontal pivot axis 61A relative to bracket 33. Left rail-segment blocker arm 71 may be coupled to stem 69 and may be arranged to engage left rail segment 15L upon movement of rail-motion blocker 61 to assume the rail-locking position. Right-rail-segment blocker arm 73 may be coupled to stem 69 and may be arranged to engage right rail segment 15R upon movement of rail-motion blocker 61 to assume the rail-locking position. In some embodiments, stem 69 may include a lower portion coupled to blocker-biasing spring 67 and an upper portion coupled to each of left and right rail-blocker arms 71, 73.

In some embodiments, bracket 33 may be formed to include an interior region (or bracket cavity) 13. Stem 69 may be arranged to lie in interior region 13 of bracket 33 during pivoting movement of rail-motion blocker 61 about the generally horizontal pivot axis 61A.

In some embodiments, left rail-blocker arm 71 may be arranged to extend in a first direction. Right rail-blocker arm may be arranged to extend in an opposite second direction. Stem 69 may cooperate with the left and right rail-blocker arms to form a T-shaped component.

In some embodiments, stem 69 may include a middle portion arranged to interconnect lower and upper portions. Rail-motion blocker 61 may also include a button-support hub 11 and a blocker mover button 79. Button support but 11 may be coupled to the middle portion of stem 69 and arranged to extend away from blocker-biasing spring 67. Blocker-mover button 79 may be coupled to the button-support hub 11 and may be arranged to extend through an aperture 49 formed in bracket 33.

In some embodiments, left rail segment 15L is configured to disengage the left rail-segment blocker arm 71 and the right rail segment 15R is configured to disengage the right rail-segment blocker arm 73 in response to upward movement of bracket 33 away from playyard floor 16 supported on rail support 90 while left and right rail segments 15L, 15R lie in the inline-use position and to subsequent pivoting movement of rail-motion blocker 61 about the generally horizontal pivot axis 61A against a biasing force generated by the blocker-biasing spring.

In some embodiments, bracket 33 may be formed to include an interior region 13. Rail-motion blocker 61 may include a stem 69 and a button support hub 11. Stem 69 may be coupled to blocker-biasing spring 67 and may be arranged to pivot about the generally horizontal pivot axis 61A. Button-support hub 11 may be coupled to stem 69 and may be arranged to extend away from blocker-biasing spring 67. Rail-motion blocker 61 may further include a blocker-mover button 79 coupled to the button-support hub 11 and arranged to extend through an aperture 49 formed in bracket 33 to open into the interior region 13.

According to another embodiment of the present disclosure, a playyard 10 may include a rail support 90, a top rail 24, 26, 28, 30, and a rail segment lock 25 as shown in FIG. 1. Rail support 90 may be adapted to support a playyard floor 16 as suggested in FIG. 1. Top rail 24, 26, 28, 30 may be coupled to rail support 90 to lie above a playyard floor 16 supported on rail support 90.

Top rail 24, 26, 28, 30 may include a left rail segment 15L, a right rail segment 15R, and a central rail segment 94. Central rail segment 94 may be arranged to interconnect left and right rail segments 15L, 15R.

Figure 10:
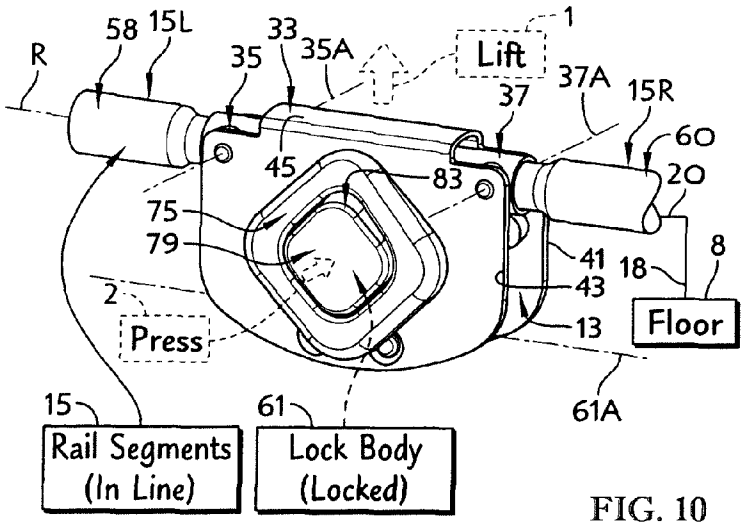
FIGS. 10-13 are a series of views showing movement of the top rail from the inline-use position to the folded-storage position in response to a user lifting the bracket, pressing the blocker-mover button, and dropping the bracket while continuing to press the blocker-mover button.
Figure 11:
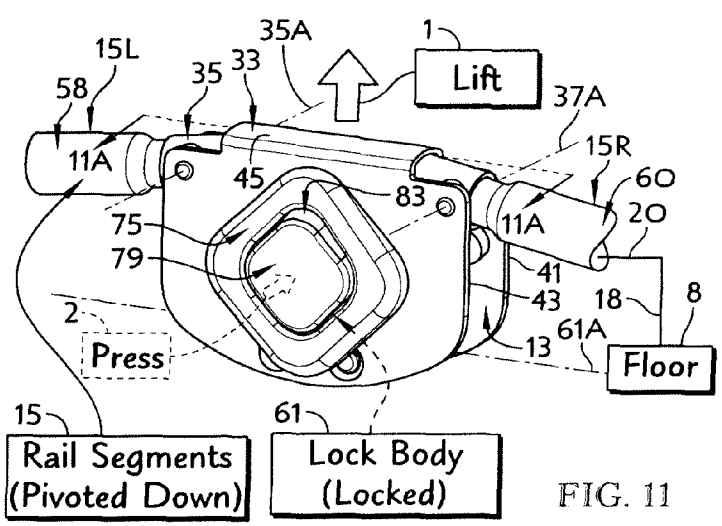
Figure 12:
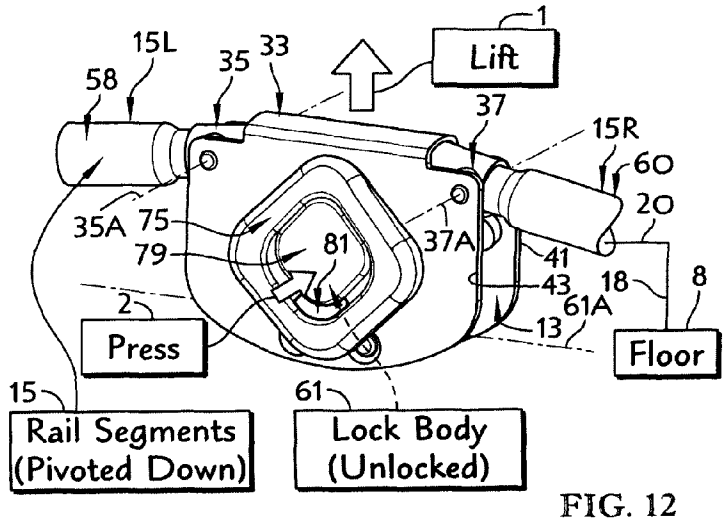
Figure 13:
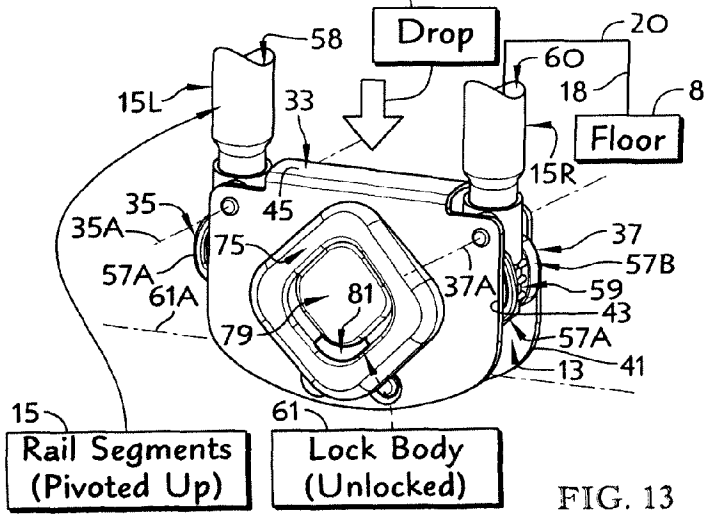

Central rail segment 94 and may be configured to support left and right rail segments 15L, 15R for movement relative to one another between an inline-use position, wherein left and right rail segments 15L, 15R extend from central rail segment 94 along a reference rail line R spaced above a playyard floor 16 supported on rail support 90 (shown in FIG. 10), and a folded-storage position, wherein left and right rail segments 15L, 15R extend upwardly from central rail segment 94 away from a playyard floor 16 supported on rail support 90 (shown in FIG. 13). Central rail segment 94 may include a bracket 33, a left fastener 102 configured to couple left rail segment 15L to bracket 33, and a right fastener 103 configured to couple right rail segment 15R to bracket 33.

Rail segment lock 25 may include a blocker-mover button 79 and release means for unlocking left rail segment 15L and right rail segment 15R for movement from the inline-use position to the folded-storage position. The release means may unlock rail segment lock 25 in response to a user lifting bracket 33 upwardly away from a playyard floor 16 supported on rail support 90, pressing blocker-mover button 79, and dropping bracket 33 toward a playyard floor 16 supported on rail support 90 while pressing blocker-mover button 79 so that left rail segment 15L and right rail segment 15R are blocked from moving from the inline-use position to the folded-storage position in response to only pressing of blocker-mover button 79.

In some embodiments, the release means may include a rail-motion blocker 61 coupled to bracket 33 for movement about a lock axis 61A from a locked position to an unlocked position. In the locked position, rail-motion blocker 61 blocks left rail segment 15L and right rail segment 15R from movement from the inline-use position to the folded-storage position. In the unlocked position, rail-motion blocker 61 allows movement of left rail segment 15L and right rail segment 15R from the inline-use position to the folded-storage position. Lock axis 61 may be arranged between reference rail line R and a playyard floor 16 supported on rail support 90 when left and right rail segments 15*l*, 15R are in the inline-use position.

In some embodiments, rail-motion blocker 61 is T-shaped and includes a button-support stem 69 coupled to bracket 33 along lock axis 61A, a left rail-segment blocker arm 71 spaced apart from lock axis 61A and arranged to extend from button-support stem 69 in a first direction, and a right rail-segment blocker arm 73 spaced apart from lock axis 61A and arranged to extend from button-support stem 69 in a second direction opposite the first direction. Left rail-segment blocker arm 71 may be arranged to block left rail segment 15L from moving from the inline-use position to the folded-storage position when rail-motion blocker 61 is in the locked position. Right rail-segment blocker arm 73 may be arranged to block right rail segment 15R from moving from the inline-use position to the folded-storage position when rail-motion blocker 61 is in the locked position.

In some embodiments, left rail segment 15L includes a left rail tube 58 and a pair of protrusions 57A, 57B coupled to left rail tube 58 and arranged to form a left rail channel 59 as shown in FIG. 9. Right rail segment 15R includes a right rail tube 60 and a pair of protrusions 57A, 57B coupled to right rail tube 60 and arranged to form a right rail channel 59. Left rail channel 59 may be arranged to receive left rail-segment blocker arm 71 of rail-motion blocker 61 when left and right rail segments 15L, 15R are in the inline-use position. Right rail channel 59 may be arranged to receive right rail-segment blocker arm 73 of rail-motion blocker 61 when left and right rail segments 15L, 15R are in the inline-use position.

In some embodiments, the release means may include a rail-motion blocker 61 coupled to bracket 33 for movement from a locked position to an unlocked position. In the locked position, rail-motion blocker 61 may be arranged to block movement of left and right rail segments 15L, 15R from the inline-use position to the folded-storage position. In the unlocked position, rail-motion blocker 61 may be arranged to allow movement of left and right rail segments 15L, 15R from the inline-use position to the folded-storage position. Rail-motion blocker 61 may move from the locked position to the unlocked position in response to a user pressing blocker-mover button 79 inwardly toward a playyard floor 16 supported on rail support 90.

In some embodiments left rail segment 15L may include a left rail tube 58 and a left protrusion 57B coupled to left rail tube 58. Right rail segment 15R may include a right rail tube 60 and a right protrusion 57B coupled to right rail tube 60. Left and right protrusions 57B may be arranged to block rail-motion blocker 61 from movement from the locked position to the unlocked position while left and right rail segments 15L, 15R are in the inline-use position.

In some embodiments, bracket 33 may be U-shaped. Bracket 33 may include a top wall 45, a front wall 43 arranged to extend downwardly from top wall 45 toward a playyard floor 16 supported on rail support 90, and a back wall arranged to extend downwardly from top wall 45 toward a playyard floor 16 supported on rail support 90 so that bracket 33 defines a bracket cavity 13.

In some embodiments, rail-motion blocker 61 may include a button-support stem 69 coupled to bracket 33 and a hub 11 coupled to button-support stem 69. Button-support stem 69 may be received in bracket cavity 13 when rail-motion blocker 61 is in the locked position and in the unlocked position. Hub 11 may extend out of bracket cavity 13 when rail-motion blocker 61 is in the locked position and may be received in bracket cavity 13 when rail-motion blocker 61 is in the unlocked position.

In some embodiments, front wall 43 of bracket 33 is formed to include an opening 49. Hub 11 of rail-motion blocker 61 may extend through opening 49 when rail-motion blocker 61 is in the locked position.

In some embodiments, playyard 10 may include a lock status indicator 29. Lock status indicator 29 may include a locked indicator 83 and an unlocked indicator 81. Locked indicator 83 may be coupled to hub 11 of rail-motion blocker 61 for movement with rail-motion blocker 61 so that locked indicator 83 is visible outside bracket cavity 13 when rail-motion blocker 61 is in the locked position and is hidden inside bracket cavity 13 when rail-motion blocker 61 is in the unlocked position. Unlocked indicator 81 may be coupled to bracket 33 and may be arranged so that hub 11 of rail-motion blocker 61 covers unlocked indicator 81 when rail-motion blocker 61 is in the locked position and is exposed when rail-motion blocker 61 is moved to the unlocked position.

According to another embodiment of the present disclosure, a playyard 10 may include a rail support 90, a top rail 24, 26, 28, 30, and a rail segment lock 25 as shown in FIG. 1. Rail support 90 may be adapted to support a playyard floor 16 as suggested in FIG. 1. Top rail 24, 26, 28, 30 may be coupled to rail support 90 to lie above a playyard floor 16 supported on rail support 90. Top rail 24, 26, 28, 30 may include a left rail segment 15L, a right rail segment 15R, and a central rail segment 94. Central rail segment 94 may be arranged to interconnect left and right rail segments 15L, 15R.

Central rail segment 94 and may be configured to support left and right rail segments 15L, 15R for movement relative to one another between an inline-use position, wherein left and right rail segments 15L, 15R extend from central rail segment 94 along a reference rail line R spaced above a playyard floor 16 supported on rail support 90 (shown in FIG. 10), and a folded-storage position, wherein left and right rail segments 15L, 15R extend upwardly from central rail segment 94 away from a playyard floor 16 supported on the rail support 90 (shown in FIG. 13). Central rail segment 94 may include a bracket 33, a left fastener 102 configured to couple left rail segment 15L to bracket 33, and a right fastener 103 configured to couple right rail segment 15R to bracket 33.

Rail segment lock 25 may include a rail-motion blocker 61 and a blocker-biasing spring 67. Rail-motion blocker 61 may be coupled to bracket 33 for movement about a lock axis 61A from a locked position to an unlocked position. In the locked position, rail-motion blocker 61 blocks movement of left and right rail segments 15L, 15R from the inline-use position to the folded-storage position. In the unlocked position, rail-motion blocker 61 allows movement of left and right rail segments 15L, 15R from the inline-use position to the folded-storage position. Blocker-biasing spring 67 may be arranged between bracket 33 and rail-motion blocker 61 to bias rail-motion blocker 61 toward the locked position.

In some embodiments, lock axis 61A may be arranged between reference rail line R and a playyard floor 16 supported on rail support 90. Lock axis 61A may extend parallel to reference rail line R.

In some embodiments, left rail segment 15L may be coupled to bracket 33 for movement about a left rail axis 35A. Right rail segment 15R may be coupled to bracket 33 for movement about a right rail axis 37A. Left and right rail axes 35A, 37A may be perpendicular to lock axis 61A.

In some embodiments, each of left rail segment and right rail segment 15L, 15R may include a rail tube 58, 60 and a pair of protrusions 57A, 57B coupled to rail tube 58, 60. Each pair of protrusions 57A, 57B may be arranged to form left and right channels 59 that receive rail-motion blocker 61 when left and right rail segments 15L, 15R are in the inline-use position.

In some embodiments, rail-motion blocker 61 may be T-shaped. Rail motion blocker 61 may include a button-support stem 69 coupled to bracket 33 for movement about lock axis 61A, a left rail-segment blocker arm 71 extending from button-support stem 69 in a first direction, and a right rail-segment blocker arm 73 extending from button-support stem 69 in a second direction, opposite the first direction. Left rail-segment blocker arm 71 may be arranged to be received in left channel 59 formed by left rail segment 15L when left rail segment 15L is in the inline-use position. Right rail-segment blocker arm 73 may be arranged to be received in right channel 59 formed by right rail segment 15R when right rail segment 15R is in the inline-use position.

In some embodiments, bracket 33 may be U-shaped. Bracket 33 may include a top wall 45, a front wall 43 arranged to extend downwardly from top wall 45 toward a playyard floor 16 supported on rail support 90, and a back wall arranged to extend downwardly from top wall 45 toward a playyard floor 16 supported on rail support 90 so that bracket 33 defines a bracket cavity 13.

In some embodiments, rail-motion blocker 61 is coupled to bracket 33 by a joint unit 95 including pins 104, 105 and spacer sleeves 63, 65. Pin 104, 105 extend through rail-motion blocker 61, back wall 41 of bracket 33, and front wall 43 of bracket 33. Spacer sleeves 63, 65 may wrap around a portion of each pin 104, 105 between rail-motion blocker 61 and back wall 41 of bracket 33 to space rail-motion blocker 61 from back wall 61 of bracket 33. Pins 104, 105 may extend perpendicular to lock axis 61A.

In some embodiments, rail-motion blocker 61 includes a button-support stem 69 coupled to bracket 33 and a hub 11 coupled to button-support stem 69. Button-support stem 69 may be received in bracket cavity 13 when rail-motion blocker 61 is in the locked position and in the unlocked position. Hub 11 may extend out of bracket cavity 13 when rail-motion blocker 61 is in the locked position and may be received in bracket cavity 13 when rail-motion blocker 61 is in the unlocked position.

In some embodiments, front wall 43 of bracket 33 is formed to include an opening 49 with a continuous perimeter. Hub 11 of rail-motion blocker 61 extends through opening 49 when rail-motion blocker 61 is in the locked position.

In some embodiments, playyard 10 may include a lock status indicator 29. Lock status indicator 29 may include a locked indicator 83 and an unlocked indicator 81. Locked indicator 83 may be coupled to hub 11 of rail-motion blocker 61 for movement with rail-motion blocker 61 so that locked indicator 83 is visible outside bracket cavity 13 when rail-motion blocker 61 is in the locked position and is hidden inside bracket cavity 13 when rail-motion blocker 61 is in the unlocked position. Unlocked indicator 81 may be coupled to bracket 33 and may be arranged so that hub 11 of rail-motion blocker 61 covers unlocked indicator 81 when rail-motion blocker 61 is in the locked position and is exposed when rail-motion blocker 61 is moved to the unlocked position.

According to another embodiment of the present disclosure, a locking device 25 for a top rail 24, 26, 28, 30 of a playyard 10 is disclosed. Top rail 24, 26, 28, 30 comprising a left rail segment 15L and a right segment 15R. Locking device 25 may be characterized in that, locking device 25 comprises a lock 61, a bracket 33, and left and right end caps 35, 37. Lock 61 movable between a locked position in which left and right rail segments 15L, 15R are blocked from being collapsed and an unlocked position in which left and right rail segments 15L, 15R are collapsible. Bracket 33 is adapted for supporting lock 61. Left end cap and right end cap 35, 37 coupled to left and right rail segments 15L, 15R, respectively, and being pivotable relative to bracket 33 together with left and right rail segments 15L, 15R, respectively. Left end cap 35 comprises a first blocking element 57A extending downwardly therefrom and right end cap 37 comprises a second blocking element 57A extending downwardly therefrom. Each of first and second blocking elements 57A being movable between an in-line position in which lock 61 is blocked from moving from the locked position to the unlocked position and a lifted position in which lock 61 is movable from the locked position to the unlocked position.

In some embodiments, locking device 25 characterized in that, lock 61 comprises a left arm 71 and a right arm 73, which are blocked from moving from the locked position to the unlocked position when first and second blocking elements 57A are in the in-line position and pivotable relative to bracket 33 from the locked position to the unlocked position when first and second blocking elements 57A are in the lifted position. In some embodiments, locking device 25 characterized in that, lock 61 is coupled to bracket 33 for pivotable movement relative to bracket 33.

In some embodiments, locking device 25 may be characterized in that, locking device 25 further comprises a button coupled to lock 61. Lock 61 is configured to move from the locked position to the unlocked position in response to first and second blocking elements 57A being moved to the lifted position and button 79 being pressed.

In some embodiments, locking device 25 characterized in that, bracket 33 comprises a back wall 41, a front wall 43 and a top wall 45 extending therebetween. Back wall 41 has an upper portion 41U and a lower portion 41L spaced from front wall 43 further than upper portion 41U to form a space between front wall 43 and lower portion 41L of back wall 41 sized to receive lock 61 when lock 61 moves from the locked position to the unlocked position.

According to another embodiment, a playyard 10 has a top rail 24, 26, 28, or 30 that includes a left rail segment 15L, a right segment 15R, and a locking device 25 pivotably connected between left and right rail segments 15L, 15R. Playyard 10 may be characterized in that, locking device 25 includes a lock 61, a bracket 33, and left and right end caps 35, 37. Lock 61 movable between a locked position in which left and right rail segments 15L, 15R are blocked from being collapsed and an unlocked position in which left and right rail segments 15L, 15R are collapsible. Bracket 33 is configured for supporting lock 61. Left end cap 35 and the right end cap 37 may be coupled to left and right rail segments 15*l*, 15R, respectively, and being pivotable relative to bracket 33 together with the left and right rail segments 15*l*, 15R, respectively. Left end cap 35 may include a first blocking element 57A extending downwardly therefrom and right end cap 37 may include a second blocking element 57A extending downwardly therefrom. Each of first and second blocking elements 57A may be movable between an in-line position in which lock 61 is blocked from moving from the locked position to the unlocked position and a lifted position in which lock 61 is movable from the locked position to the unlocked position.

In some embodiments, lock 61 comprises a left arm 71 and a right arm 73. Left and right arms 71, 73 are blocked from moving from the locked position to the unlocked position when first and second blocking elements 57A are in the in-line position and are pivotable relative to bracket 33 from the locked position to the unlocked position when first and second blocking elements 57A are in the lifted position.

In some embodiments, lock 61 is coupled to bracket 33. Lock 61 may be pivotable relative to bracket 33.

In some embodiments, playyard 10 includes a button 79 coupled to lock 61. Lock 61 may be moved from the locked position to the unlock position in response to first and second blocking elements 57A being moved to the lifted position and button 79 being pressed.

In some embodiments, bracket 33 comprises a back wall 41, a front wall 43 and a top wall 45 extended therebetween. Back wall 41 has an upper portion 41U and a lower portion 41L spaced further from front wall 43 than upper portion 41U to form a space between front wall 43 and lower portion 41L of back wall 41 sized to receive lock 61 when lock 61 moves from the locked position to the unlocked position.

The invention claimed is:

1. A playyard comprising a collapsible frame including a rail segment lock and rail support adapted to support a playyard floor and a top rail including a left rail segment, a center rail segment, and a right rail segment, wherein the rail support is configured to fold to be moved between an erected configuration to support the floor and a collapsed configuration without the floor, the top rail is coupled to the rail support of the collapsible frame and arranged to lie above a playyard floor supported on the rail support of the collapsible frame upon movement of the rail support of the collapsible frame to the erected configuration, the left rail segment of the top rail is coupled to a left corner leg included in the rail support of the collapsible frame, the right rail segment of the top rail is coupled to a right corner leg included in the rail support of the collapsible frame, the center rail segment of the top rail is arranged to interconnect the left and right rail segments and to support the left and right rail segments for movement relative to one another between an inline-use position wherein the left and right rail segments are arranged to extend along a generally horizontal reference line extending between the left and right corner legs and a folded-storage position wherein the left and right rail segments are arranged to extend in a generally vertical orientation in substantially perpendicular relation to the generally horizontal reference line, the center rail segment of the top rail includes a button-support bracket, a left fastener coupled to the bracket and to the left rail segment to support the left rail segment for movement relative to the bracket during movement of the left and right rail segments between the inline-use and folded-storage positions, and a right fastener coupled to the bracket and to the right rail segment to support the right rail segment for movement relative to the bracket during movement of the left and right rail segments between the inline-use and folded-storage positions, and the rail segment lock includes a rail-motion blocker mounted on the bracket for pivotable movement about a single generally horizontal pivot axis that is arranged to lie in substantially spaced-apart parallel relation to the generally horizontal reference line when the rail support of the collapsible frame is in the erected configuration and left and right rail segments are in the inline-use position between a rail-locking position engaging the left and right rail segments to block movement of the left and right rail segments toward the folded-storage position and a rail-unlocking position disengaging the left and right rail segments to free the left and right rail segments to move toward the folded-storage position.

2. The playyard of claim 1, wherein the rail segment lock further includes a blocker-biasing spring coupled to the bracket and to the rail-motion blocker and configured to provide means for yieldably urging the rail-motion blocker to move relative to the bracket normally to assume the rail-locking position.

3. The playyard of claim 2, wherein the rail-motion blocker includes a stem mounted for pivotable movement about the generally horizontal pivot axis relative to the bracket, a left rail-segment blocker arm coupled to the stem and arranged to engage the left rail segment upon movement of the rail-motion blocker to assume the rail-locking position, and a right-rail-segment blocker arm coupled to the stem and arranged to engage the right rail segment upon movement of the rail-motion blocker to assume the rail-locking position.

4. The playyard of claim 3, wherein the stem includes a lower portion coupled to the blocker-biasing spring and an upper portion coupled to each of the left and right rail-blocker arms.

5. The playyard of claim 4, wherein the bracket is formed to include an interior region and the stem is arranged to lie in the interior region of the bracket during pivoting movement of the rail-motion blocker about the generally horizontal pivot axis.

6. The playyard of claim 4, wherein the left rail-blocker arm is arranged to extend in a first direction, the right rail-blocker arm is arranged to extend in an opposite second direction, and the stem cooperates with the left and right rail-blocker arms to form a T-shaped component.

7. The playyard of claim 4, wherein the stem further includes a middle portion arranged to interconnect the lower and support portions, and the rail-motion blocker further includes a button-support hub coupled to the middle portion of the stem and arranged to extend away from the blocker-biasing spring and a blocker-mover button coupled to the button-support hub and arranged to extend through an aperture formed in the bracket.

8. The playyard of claim 3, wherein the left rail segment is configured to disengage the left rail-segment blocker arm and the right rail segment is configured to disengage the right rail-segment blocker arm in response to upward movement of the bracket away from the floor supported on the rail support while the left and right rail segments lie in the inline-use position and to subsequent pivoting movement of the rail-motion blocker about the generally horizontal pivot axis against a biasing force generated by the blocker-biasing spring.

9. The playyard of claim 8, wherein the bracket is formed to include an interior region and the rail-motion blocker includes a stem that is coupled to the blocker-biasing spring and arranged to pivot about the generally horizontal pivot axis and a button-support hub coupled to the stem and arranged to extend away from the blocker-biasing spring, the rail-motion blocker further includes a blocker-mover button coupled to the button-support hub and arranged to extend through an aperture formed in the bracket to open into the interior region.

10. A playyard comprising a rail support adapted to support a playyard floor, a top rail coupled to the rail support to lie above a playyard floor supported on the rail support, the top rail including a left rail segment, a right rail segment, and a central rail segment arranged to interconnect the left and right rail segments and configured to support the left and right rail segments for movement relative to one another between an inline-use position wherein the left and right rail segments extend from the central rail segment along a reference rail line spaced above a playyard floor supported on the rail support and a folded-storage position wherein the left and right rail segments extend upwardly from the central rail segment away from a playyard floor supported on the rail support, the central rail segment including a bracket, a left fastener configured to couple the left rail segment to the bracket, and a right fastener configured to couple the right rail segment to the bracket, and a rail segment lock including a blocker-mover button and release means for unlocking the left rail segment and the right rail segment for movement from the inline-use position to the folded-storage position in response to a user lifting the bracket upwardly away from a playyard floor supported on the rail support, pressing the blocker-mover button, and dropping the bracket toward a playyard floor supported on the rail support while pressing the blocker-mover button so that the left rail segment and the right rail segment are blocked from moving from the inline-use position to the folded-storage position in response to only pressing of the blocker-mover button.

11. The playyard of claim 10, wherein the release means includes a rail-motion blocker coupled to the bracket for movement about a lock axis from a locked position, wherein the rail-motion blocker blocks the left rail segment and the right rail segment from movement from the inline-use position to the folded-storage position, to an unlocked position, wherein the rail-motion blocker allows movement of the left rail segment and the right rail segment from the inline-use position to the folded-storage position, the lock axis arranged between the reference rail line and a playyard floor supported on the rail support when the left and right rail segments are in the inline-use position.

12. A playyard comprising a rail support adapted to support a playyard floor, a top rail coupled to the rail support to lie above a playyard floor supported on the rail support, the top rail including a left rail segment, a right rail segment, and a central rail segment arranged to interconnect the left and right rail segments and configured to support the left and right rail segments for movement relative to one another between an inline-use position wherein the left and right rail segments extend from the central rail segment along a reference rail line spaced above a playyard floor supported on the rail support and a folded-storage position wherein the left and right rail segments extend upwardly from the central rail segment away from a playyard floor supported on the rail support, the central rail segment including a bracket, a left fastener configured to couple the left rail segment to the bracket, and a right fastener configured to couple the right rail segment to the bracket, a rail segment lock including a blocker-mover button and release means for unlocking the left rail segment and the right rail segment for movement from the inline-use position to the folded-storage position in response to a user lifting the bracket upwardly away from a playyard floor supported on the rail support, pressing the blocker-mover button, and dropping the bracket toward a playyard floor supported on the rail support while pressing the blocker-mover button so that the left rail segment and the right rail segment are blocked from moving from the inline-use position to the folded-storage position in response to only pressing of the blocker-mover button, wherein the release means includes a rail-motion blocker coupled to the bracket for movement about a lock axis from a locked position, wherein the rail-motion blocker blocks the left rail segment and the right rail segment from movement from the inline-use position to the folded-storage position, to an unlocked position, wherein the rail-motion blocker allows movement of the left rail segment and the right rail segment from the inline-use position to the folded-storage position, the lock axis arranged between the reference rail line and a playyard floor supported on the rail support when the left and right rail segments are in the inline-use position, and wherein the rail-motion blocker is T-shaped and includes a button-support stem coupled to the bracket along the lock axis, a left rail-segment blocker arm spaced apart from the lock axis and arranged to extend from the button-support stem in a first direction, and a right rail-segment blocker arm spaced apart from the lock axis and arranged to extend from the button-support stem in a second direction opposite the first direction, the left rail-segment blocker arm arranged to block the left rail segment from moving from the inline-use position to the folded-storage position when the rail-motion blocker is in the locked position, and the right rail-segment blocker arm arranged to block the right rail segment from moving from the inline-use position to the folded-storage position when the rail-motion blocker is in the locked position.

13. The playyard of claim 12, wherein the left rail segment includes a left rail tube and a pair of protrusions coupled to the left rail tube and arranged to form a left rail channel, the right rail segment includes a right rail tube and a pair of protrusions coupled to the right rail tube and arranged to form a right rail channel, the left rail channel arranged to receive the left rail-segment blocker arm of the rail-motion blocker when the left and right rail segments are in the inline-use position, and the right rail channel arranged to receive the right rail-segment blocker arm of the rail-motion blocker when the left and right rail segments are in the inline-use position.

14. A playyard comprising a rail support adapted to support a playyard floor, a top rail coupled to the rail support to lie above a playyard floor supported on the rail support, the top rail including a left rail segment, a right rail segment, and a central rail segment arranged to interconnect the left and right rail segments and configured to support the left and right rail segments for movement relative to one another between an inline-use position wherein the left and right rail segments extend from the central rail segment along a reference rail line spaced above a playyard floor supported on the rail support and a folded-storage position wherein the left and right rail segments extend upwardly from the central rail segment away from a playyard floor supported on the rail support, the central rail segment including a bracket, a left fastener configured to couple the left rail segment to the bracket, and a right fastener configured to couple the right rail segment to the bracket, a rail segment lock including a blocker-mover button and release means for unlocking the left rail segment and the right rail segment for movement from the inline-use position to the folded-storage position in response to a user lifting the bracket upwardly away from a playyard floor supported on the rail support, pressing the blocker-mover button, and dropping the bracket toward a playyard floor supported on the rail support while pressing the blocker-mover button so that the left rail segment and the right rail segment are blocked from moving from the inline-use position to the folded-storage position in response to only pressing of the blocker-mover button, wherein the release means includes a rail-motion blocker coupled to the bracket for movement from a locked position, arranged to block movement of the left and right rail segments from the inline-use position to the folded-storage position, to an unlocked position, arranged to allow movement of the left and right rail segments from the inline-use position to the folded-storage position, in response to a user pressing the blocker-mover button inwardly toward a playyard floor supported on the rail support.

15. The playyard of claim 14, wherein the left rail segment includes a left rail tube and a left protrusion coupled to the left rail tube, the right rail segment includes a right rail tube and a right protrusion coupled to the right rail tube, the left and right protrusions arranged to block the rail-motion blocker from movement from the locked position to the unlocked position while the left and right rail segments are in the inline-use position.

16. The playyard of claim 14, wherein the bracket is U-shaped and includes a top wall, a front wall arranged to extend downwardly from the top wall toward a playyard floor supported on the rail support, and a back wall arranged to extend downwardly from the top wall toward a playyard floor supported on the rail support so that the bracket defines a bracket cavity.

17. The playyard of claim 16, wherein the rail-motion blocker includes a button-support stem coupled to the bracket and a hub coupled to the button-support stem, the button-support stem received in the bracket cavity when the rail-motion blocker is in the locked position and in the unlocked position, and the hub extends out of the bracket cavity when the rail-motion blocker is in the locked position and is received in the bracket cavity when the rail-motion blocker is in the unlocked position.

18. The playyard of claim 17, wherein the front wall of the bracket is formed to include an opening and the hub of the rail-motion blocker extends through the opening when the rail-motion blocker is in the locked position.

19. The playyard of claim 17, further comprising a lock status indicator including a locked indicator and an unlocked indicator, wherein the locked indicator is coupled to the hub of the rail-motion blocker for movement with the rail-motion blocker so that the locked indicator is visible outside the bracket cavity when the rail-motion blocker is in the locked position and is hidden inside the bracket cavity when the rail-motion blocker is in the unlocked position, and the unlocked indicator is coupled to the bracket and arranged to be covered by the rail-motion blocker when the rail-motion blocker is in the locked position and is exposed when the rail-motion blocker is moved to the unlocked position.

20. A playyard comprising a rail support adapted to support a playyard floor, a top rail coupled to the rail support to lie above a playyard floor supported on the rail support, the top rail including a left rail segment, a right rail segment, and a central rail segment arranged to interconnect the left and right rail segments and configured to support the left and right rail segments for movement relative to one another between an inline-use position wherein the left and right rail segments extend from the central rail segment along a reference rail line spaced above a playyard floor supported on the rail support and a folded-storage position wherein the left and right rail segments extend upwardly from the central rail segment away from a playyard floor supported on the rail support, the central rail segment including a bracket, a left fastener configured to couple the left rail segment to the bracket, and a right fastener configured to couple the right rail segment to the bracket, and a rail segment lock including a rail-motion blocker and a blocker-biasing spring, the rail-motion blocker coupled to the bracket for movement about a single lock axis from a locked position, wherein the rail-motion blocker blocks movement of the left and right rail segments from the inline-use position to the folded-storage position, to an unlocked position, wherein the rail-motion blocker allows movement of the left and right rail segments from the inline-use position to the folded-storage position, the blocker-biasing spring arranged between the bracket and the rail-motion blocker to bias the rail-motion blocker toward the locked position.

21. The playyard of claim 20, wherein the lock axis is arranged between the reference rail line and a playyard floor supported on the rail support and extends parallel to the reference rail line.

22. The playyard of claim 21, wherein the left rail segment is coupled to the bracket for movement about a left rail axis, the right rail segment is coupled to the bracket for movement about a right rail axis, and the left and right rail axes are perpendicular to the lock axis.

23. The playyard of claim 20, wherein each of the left rail segment and the right rail segment includes a rail tube and a pair of protrusions coupled to the rail tube, the pair of protrusions being arranged to form left and right channels that receive the rail-motion blocker when the left and right rail segments are in the inline-use position.

24. The playyard of claim 23, wherein the rail-motion blocker is T-shaped and includes a button-support stem coupled to the bracket for movement about the lock axis, a left rail-segment blocker arm extending from the button-support stem in a first direction and arranged to be received in the left channel formed by the left rail segment when the left rail segment is in the inline-use position, and a right rail-segment blocker arm extending from the button-support stem in a second direction, opposite the first direction, and arranged to be received in the right channel formed by the right rail segment when the right rail segment is in the inline-use position.

25. The playyard of claim 20, wherein the bracket is U-shaped and includes a top wall, a front wall arranged to extend downwardly from the top wall toward a playyard floor mat supported on the frame floor, and a back wall arranged to extend downwardly from the top wall toward a playyard floor mat supported on the frame floor so that the bracket defines a bracket cavity.

26. The playyard of claim 25, wherein the rail-motion blocker is coupled to the bracket by a joint unit including a pin and a spacer sleeve, the pin extends through the rail-motion blocker, the back wall of the bracket, and the front wall of the bracket, and the spacer sleeve wraps around a portion of the pin between the rail-motion blocker and the back wall of the bracket to space the rail-motion blocker from the back wall of the bracket.

27. The playyard of claim 26, wherein the pin included in the joint unit extends perpendicular to the lock axis.

28. The playyard of claim 25, wherein the rail-motion blocker includes a button-support stem coupled to the bracket and a hub coupled to the button-support stem, the button-support stem received in the bracket cavity when the rail-motion blocker is in the locked position and in the unlocked position, and the hub extends out of the bracket cavity when the rail-motion blocker is in the locked position and is received in the bracket cavity when the rail-motion blocker is in the unlocked position.

29. The playyard of claim 28, wherein the front wall of the bracket is formed to include an opening with a continuous perimeter and the hub of the rail-motion blocker extends through the opening when the rail-motion blocker is in the locked position.

30. The playyard of claim 28, further comprising a lock status indicator including a locked indicator and an unlocked indicator, wherein the locked indicator is coupled to the hub of the rail-motion blocker for movement with the rail-motion blocker so that the locked indicator is visible outside the bracket cavity when the rail-motion blocker is in the locked position and is hidden inside the bracket cavity when the rail-motion blocker is in the unlocked position, and the unlocked indicator is coupled to the bracket and arranged to be covered by the rail-motion blocker when the rail-motion blocker is in the locked position and is exposed when the rail-motion blocker is moved to the unlocked position.

* * * * *